United States Patent [19]

Grubb

[11] 3,931,726

[45] Jan. 13, 1976

[54] PROPELLANT-DRIVEN DEVICE FOR CRIMPING LARGE SIZE WIRE AND TERMINALS

[75] Inventor: Daniel Baker Grubb, Hummelstown, Pa.

[73] Assignee: AMP Incorporated, Harrisburg, Pa.

[22] Filed: Jan. 21, 1975

[21] Appl. No.: 542,731

[52] U.S. Cl. ..... 72/430; 29/203 DT; 29/254; 29/421 E; 60/636; 89/1 B

[51] Int. Cl.[2] ..... B21J 15/24

[58] Field of Search ..... 29/421 E, 203 DT, 203 D, 29/254; 60/632, 636; 72/430, 56; 89/1 B; 102/70 R, 70 AC, 70 S

[56] References Cited

UNITED STATES PATENTS

| | | | |
|---|---|---|---|
| 2,030,803 | 2/1936 | Temple, Jr. | 29/254 |
| 2,149,814 | 3/1939 | Littlehale | 89/1 B |
| 3,187,500 | 6/1965 | Broske et al. | 60/636 |
| 3,434,421 | 3/1969 | Berlin et al. | 102/70 R |
| 3,599,308 | 8/1971 | Fielder | 72/430 |
| 3,640,012 | 2/1972 | Schermuly | 89/1 B |
| 3,780,689 | 12/1973 | Giebel et al. | 89/1 B |

*Primary Examiner*—Carl E. Hall

*Attorney, Agent, or Firm*—Allan B. Osborne, Esquire

[57] ABSTRACT

This invention relates to a device, actuated by a propellant, for crimping heavy-walled terminals about large size electrical wire.

1 Claim, 8 Drawing Figures

PROPELLANT-DRIVEN DEVICE FOR CRIMPING LARGE SIZE WIRE AND TERMINALS

BACKGROUND OF THE INVENTION

Diesel locomotives of the type having electrically-driven traction motors require wire of a size capable of carrying a current of around 1100 amps. The size of aluminum multi-strand wire having this capability is on the order of one million circular mils in cross-sectional area. The current carrying requirements and physical wire size have provided workers in the field with a problem in terminating so as to prevent terminal overheating and failure. One solution to this problem was to use heavy-walled copper terminals. However, heretofore, means of manageable size adequate to crimp a heavy-walled copper terminal around a million circular mil wire were not available, particularly when copper wire was used. In conjunction with this, aluminum wire can be used as a replacement for the copper wire offering numerous advantages, such as weight and cost savings, and reduced resistance to crimping when high pressures may be required.

As is well known, the undesirable properties of creep, cold flow, oxidation, thermal expansion and corrosion which are inherent in aluminum have to be overcome in providing a reliable and stable termination. Prior to recent developments in the field of crimp terminations for aluminum wire, welding was the only method for avoiding the aforementioned undesirable properties. This method, however, was both costly and time consuming and provided only marginal results in many instances. Now however, the development of the aluminum crimp techniques as disclosed in U.S. Pat. applications, Ser. No. 346,530, filed on Mar. 29, 1973 and Ser. No. 481,590, filed on June 21, 1974, the disclosures of both being incorporated herein by reference, teaches methods which overcome the aforementioned properties in an inexpensive manner and with excellent results. Generally and briefly, these methods provide a perforated liner between the wire and wire barrel and further use crimping forces sufficiently high to deform the terminal and wire by a factor of 65 percent. Utilizing these methods however with heavy-walled copper terminals and wire of one million circular mils in cross-sectional area presented problems, the solution to which were not obvious.

Manually operated tools capable of crimping large size terminals are heavy, bulky and generally do not provide the pressures required. Tools operated by electricity or compressed air are bulky and expensive. Further, power or compressed air is not always available at the sites where the termination is to be made.

With these limitations in mind, Applicant considered propellant-driven devices with which Applicant's assignee has some experience; e.g., U.S. Pat. Nos. 3,163,200 and 3,187,500, the disclosures thereof being incorporated herein. U.S. Pat. Nos. 2,981,130, 2,995,053 and 3,251,216, assigned to Applicant's assignee also, are additional state of the art disclosures.

It was discovered however that the tools disclosed in the aforementioned patents lacked the capabilities required. One problem was in the propellant-carrying element and means for exhausting the gases. Another problem was that of providing a method for driving the moving die out of engagement with the terminal after crimping it around the wire. The solution to these and other problems resulted in the instant invention which provides a propellant-driven device having a elongated housing whose walls define an interior chamber. One die is fixed at one end of the chamber and a second, movable die is slidingly positioned therein so that it can be driven against a terminal placed on the first die. The other end of the chamber contains a recess for receiving the rim of a cartridge containing the propellant. The cartridge is made of a plastic which, upon detonation of the propellant, separates and becomes gas-tight seals. The cap or closure means contain the firing mechanism and also a combination safety to prevent unintentional detonation and a means to seal off a gas release passageway which connects the chamber to outside the housing.

DESCRIPTION OF THE PREFERRED EMBODIMENT

Figure 1:
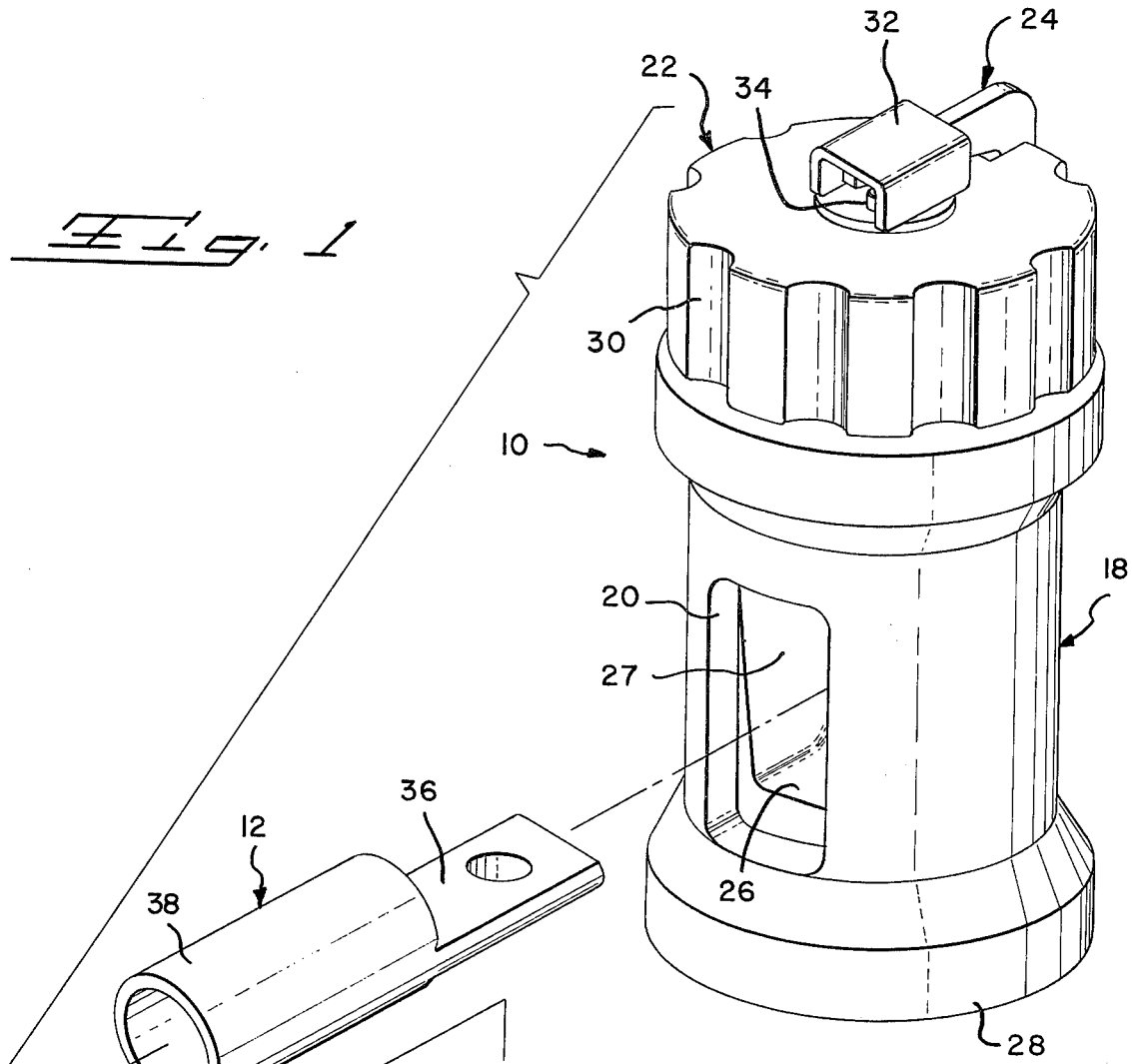
FIG. 1 is a perspective view of the preferred embodiment constructed in accordance with the present invention. A closed barrel terminal and prepared wire are shown to the left.
Figure 2:
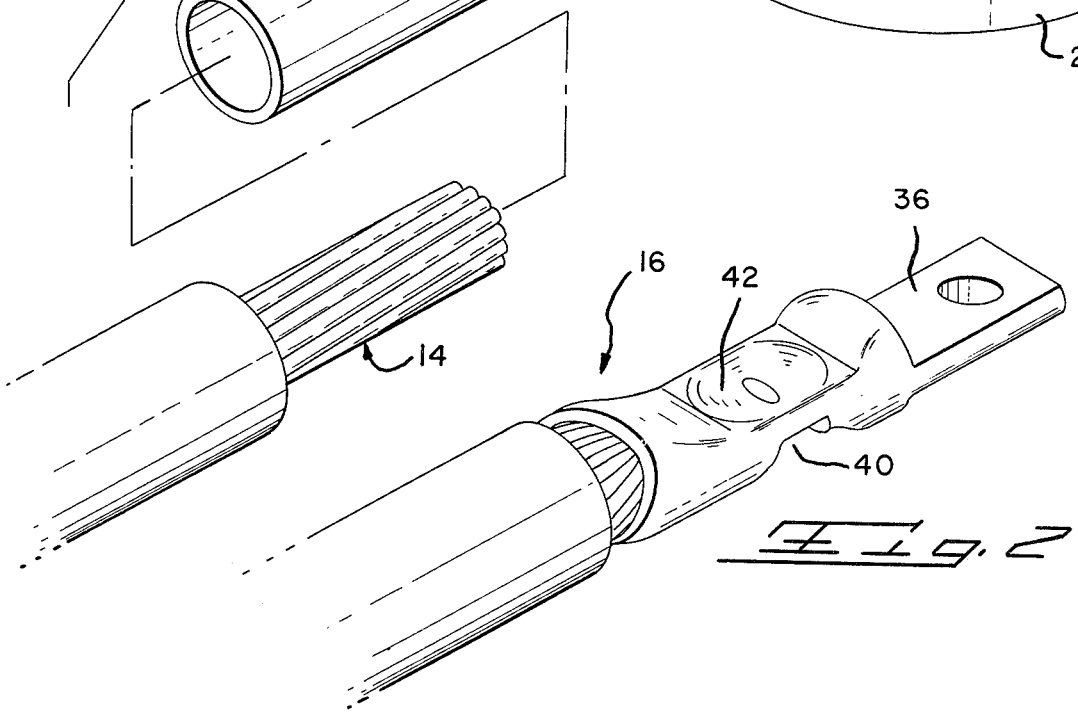
FIG. 2 is a view of the wire and terminal after being crimped together by the preferred embodiment shown in FIG. 1.

Referring now to the drawings wherein like reference numerals represent corresponding parts in all Figures, there is shown on the right in FIG. 1 a device 10 which is used for crimping a heavy-walled terminal 12, seen on the left, into encompassing engagement with a large diameter wire 14 to provide the termination 16 shown in FIG. 2.

Device 10, also referred to as a propellant-driven crimping press, possesses the following visible outer elements; a housing 18, a lateral window 20 which has a counterpart on the housing's opposite side (see FIG. 3), a closure means or cap 22 and a safety means or safety arm 24.

A fixed die 26, or nest, may be seen through window 20. This die is U-shaped with sidewalls 27 extending upwardly from either side of the die's floor.

Housing 18 is preferably provided with an enlarged base 28 so that device 10 may stand free. Cap 22 contains lateral flutes 30 as shown for ease in handling. Safety arm 24 has a cover 32 on its free end to shield firing pin assembly 34 centrally positioned in cap 22.

Terminal 12 consists of a ring tongue front end 36 and a closed wire barrel 38. Dimensionally the wire barrel is about 4½ inches long and has a wall thickness of 0.20 inches. The terminal is made from copper, plated with tin and weighs about 2 pounds.

Wire 14 is a multi-strand aluminum cable having a cross-sectional area of about one million circular mils. In order to achieve a reliable crimp the terminal and wire must be deformed to about 40 percent of the non-deformed cross-sectional area. The force required to achieve this degree of deformation on the heavy-walled terminal and large diameter wire is about 65 tons per square inch.

FIG. 2 illustrates the high deformation crimp achieved via device 10. A transverse bar 39 (FIG. 3), located on the floor of the fixed die 26, pushes in (relatively speaking) on the bottom of wire barrel 38 as shown by reference numeral 40. The deformation extends completely across the wire barrel. The moveable die (reference numeral 54 in FIG. 3) pushes in on the top of the wire barrel in a generally oval pattern as indicated by reference numeral 42. The strands of wire inbetween the two deformed areas are both extruded longitudinally and cold welded together. The extrusion process breaks up aluminum oxide which may be present on the strands thereby providing fresh or clean metal to adjacent strands which enhances the process of cold welding.

Figure 3:
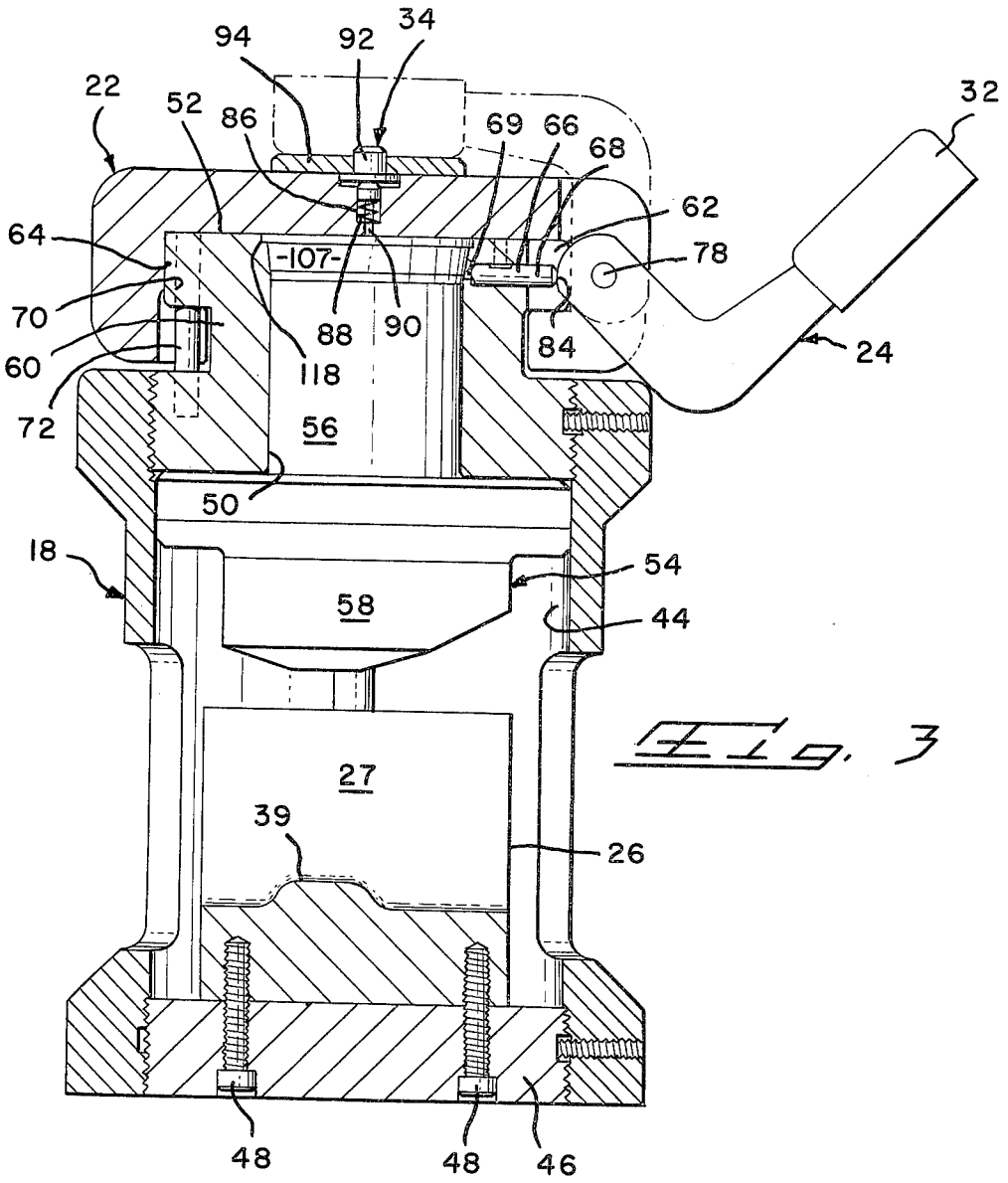
FIG. 3 is a sectionized view of the preferred embodiment shown in FIG. 1.

The internal details of device 10 may be seen in FIG. 3. Chamber 44 within the housing is closed at its lower end by a plug 46. A pair of screws 48 extend through the plug and secure fixed die 26 thereto.

The upper part of the housing contains a passageway 50 which is concentric with and connects chamber 44 with the top surface 52 of the housing. A moveable die 54, shown in its raised position in the device has a piston 56 at its upper end and an anvil 58 at its lower end. As FIG. 3 indicates piston 56 fits very closely in passageway 50.

Figure 5:
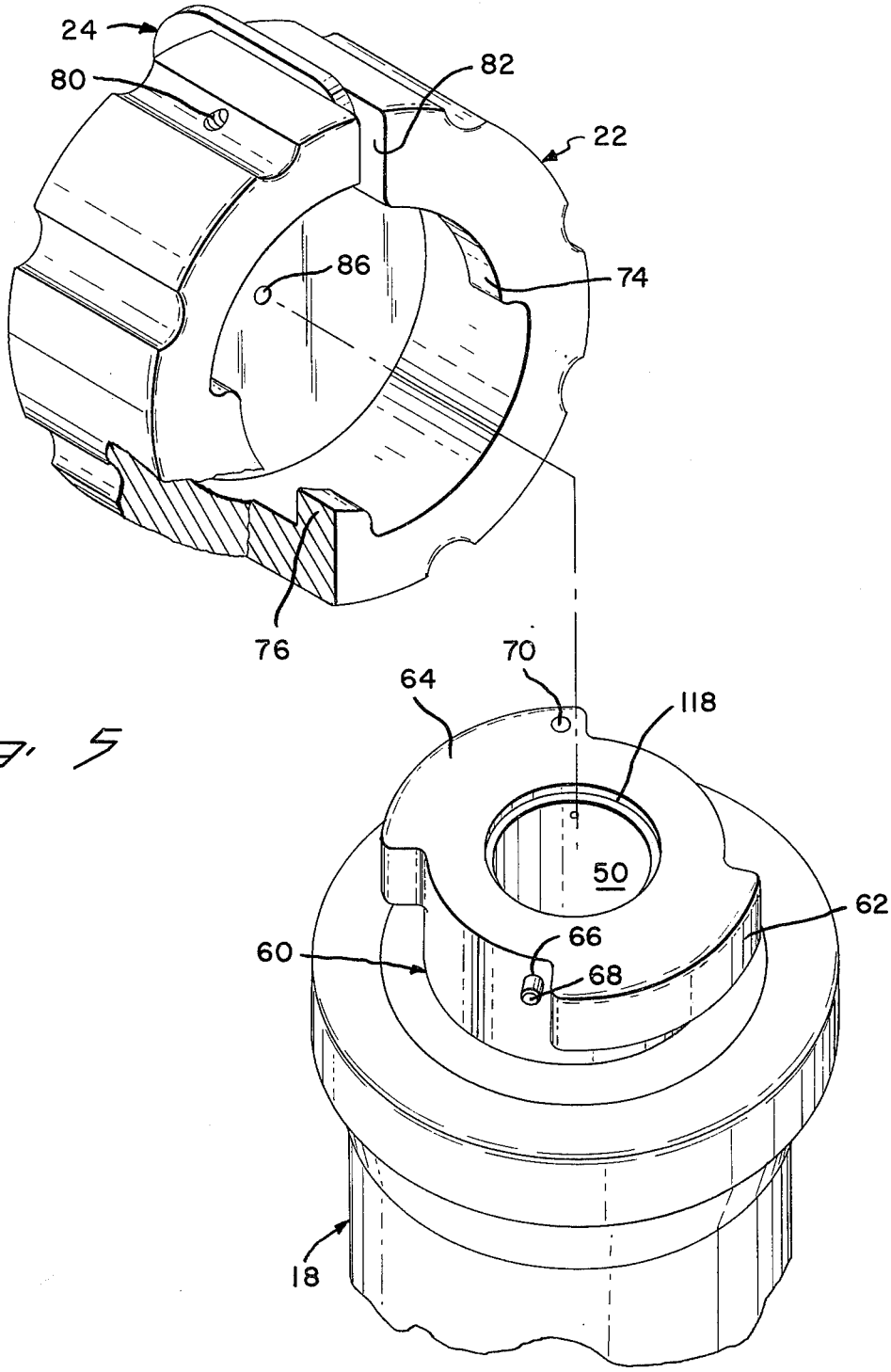
FIG. 5 shows details of the locking mechanism of the preferred embodiment.

With reference to FIG. 5 also, the outside upper portion of housing 18 has a portion of reduced diameter to form a cap-receiving section 60. Section 60 is cylindrical and has first and second laterally projecting lugs, reference numerals 62 and 64 respectively, each spaced diametrically with respect to the other. Both lugs are relatively thick to provide adequate locking means for cap 22. Lug 62 has a radius of about 82° and lug 64 has a radius of 90°.

A horizontal gas release passage 65 and gas release pin 68 slidingly housed in passage 66 are positioned in section 60 off to one side of lug 62. Referring specifically to FIG. 3, the passage's diameter is abruptly reduced adjacent passageway 50 and pin 68 has a reduced diameter stud 69 which fits sealingly into the reduced area.

Stop means comprised of a vertical passage 70 and rod 72 is positioned through lug 64 and into the lower cap receiving section 60.

With continuing reference to FIGS. 1, 3 and 5, cap 22 forms a closure means for housing 18 and chamber 44. The lower edge of the cap contains two inwardly projecting flanges 74 and 76 respectively, one being positioned opposite the other. These flanges cooperate with lugs 62 and 64 in securing cap 22 to housing 18, flange 74 sliding below lug 62 and flange 76 sliding below lug 64.

L-shaped safety arm 24 is pivotably mounted on the side of cap 22, pivoting being provided by pin 78 located in a horizontal passageway 80. A slot 82 in the side of the cap receives part of the arm when it is in its safety position covering firing pin assembly 34 as shown in FIG. 5. Safety arm 24 is positioned on cap 22 so that as it is pivoted back, uncovering firing pin assembly 34, its pivotably mounted end 84 engages and pushes gas release pin 68 inwardly thereby sealing off passage 66.

With reference specifically to FIG. 3, firing pin assembly 34 consists of firing pin passage 86, a spring 88, a firing pin 90, and a firing pin striker 92 moveably positioned over pin 90. A retaining plate 94, secured to cap 22 by conventional means, provides retaining means for the firing pin assembly.

Figure 6:
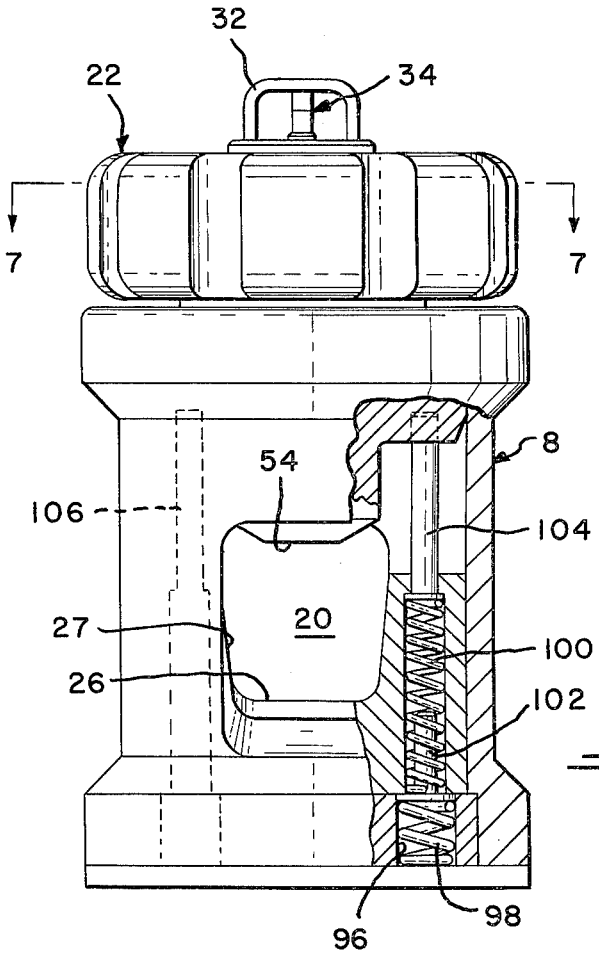
FIG. 6 is a partially sectionized view of the preferred embodiment illustrating the anvil return spring mechanism.

FIG. 6 illustrates the means for biasing moveable die 54 against the upper part of chamber 44. These means consist of vertical passageway 96, a heavy lower spring 98 and a lighter upper spring 100, both mounted on a lower pin 102. A hollow spring compressing rod 104 is secured to a bottom surface of moveable die 54. The dashed lines 106, seen on the opposite side of housing 18 indicate the location of a second identical set of biasing means.

Figure 4:
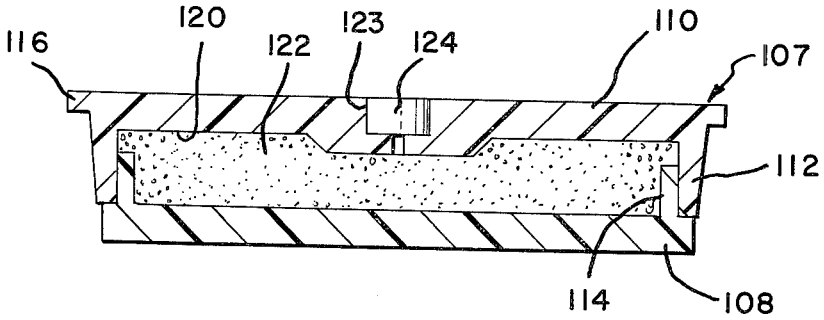
FIG. 4 is a cross-sectional view of the cartridge used in the preferred embodiment.

The propellant means for propelling moveable die 54 downwardly toward fixed die 26 is shown in FIG. 4. These means include a cartridge 107 which consists of a lower, cup shaped base 108 and a cover 110. The material used in making these two parts is preferably nylon. Cover 110 has a downwardly depending skirt 112 which slides over upstanding walls 114 on base 108 thereby forming a chamber 120. Cover 110 also has a lateral rim 116 extending around its periphery. This rim sets in a circumferential groove 118 located at the open end of passageway 50 of the cap-receiving section 60. FIG. 5 shows the groove clearly. Propellant 122, which may be Bullseye smokeless powder, manufactured by E. I. DuPont deNemours & Company, fills chamber 120. Cover 110 contains an opening 123 in which, primer 124 is positioned. Primer 124 is detonated by being struck by firing pin 90.

Figure 7:
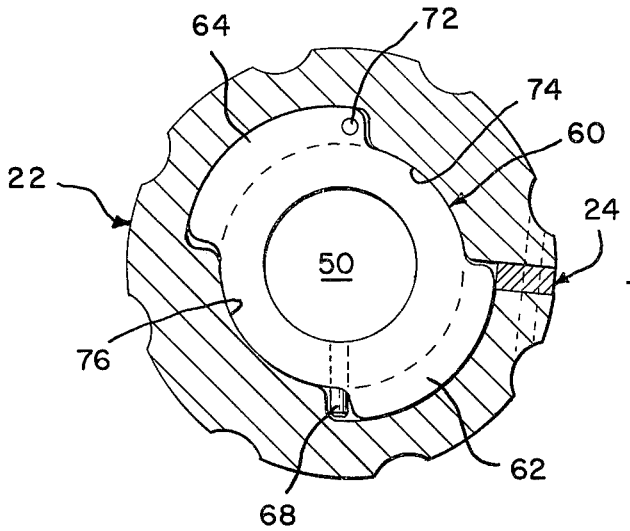
FIGS. 7 and 8, both being views taken along lines 7—7 of FIG. 6, illustrate the functional aspects of the locking mechanism of the preferred embodiment of FIG. 1.
Figure 8:
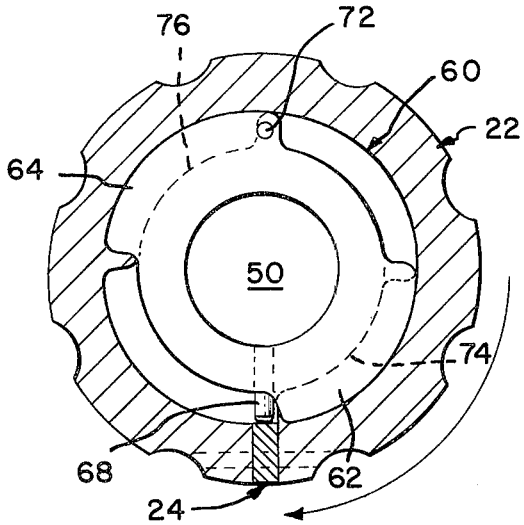

FIGS. 7 and 8 illustrate the mechanics of securing cap 22 to cap-receiving section 60. In FIG. 7, cap 22 has been placed over cap-receiving section 60. Note that flange 76 on cap 22 spans the space between gas release pin 68 and lug 64. Also note that safety arm 24 is positioned at the end of lug 62 opposite the gas release pin.

In FIG. 8 cap 22 has been rotated clockwise to where one end of flange 76, shown as dashed lines, abuts against rod 72. Both flanges 74 and 76 are under lugs 62 and 64 respectively and safety arm 24 is bearing against gas release pin 68.

The utilization of device 10 is straight-forward, lending itself to use by even the most unskilled workman with only a minimal amount of training.

Beginning with the device as shown in FIG. 5; i.e., cap 22 being removed, a cartridge 107 is placed into the top of passageway 50 with rim 116 being seated in groove 118. Cap 22 is placed on cap-receiving section 60 (FIG. 7) and rotated clockwise (FIG. 8) until flange 76 abuts rod 72. Device 10 is now as such is shown in FIGS. 1 and 6; i.e., cover 32 on safety arm 24 shielding firing pin assembly 34. The stripped end of wire 14 is now inserted into wire barrel 38 of terminal 12. Terminal 12 is then placed into fixed die 26 via window 20 so that the approximate middle of the wire barrel is resting on bar 39 located on the fixed die.

Safety arm 24 is pivoted outwardly, thereby exposing firing assembly 34 and simultaneously pressing in on gas release pin 68 thereby sealing off gas release passage 66. Upon striking firing pin striker 92, firing pin 90 detonates primer 124 which in turn detonates propellant 122. The gases generated thereby expand, driving moveable die 54 downwardly. Base 108, which becomes separated from the cover 110 of cartridge 107, acts as a seal around piston 56 thereby preventing gas from blowing by. Die 54 strikes and crimps terminal 12 between it and fixed die 26. After the force of the burning gases have been expended, heavy spring 98 acts to drive the die out from engagement with crimped terminal 12 and lighter spring 100 pushes the die up to its normal position. Safety arm 24 is pivoted back onto cap 22 thereby releasing gas release pin 68 and the residue gas in the chamber above piston 56.

Using 70 grains of Bullseye powder, the propellant-driven device disclosed above develops on the order of 65 tons pressure per square inch. Tests show that this energy is required to achieve a satisfactory crimp of a wire barrel having a 2 inch diameter with walls 0.20 inches thick. The dimensions of the device used include a housing 18 having a height of 10.12 inches and made from alloy steel. The diameter of chamber 44 is 2.24 inches. The radius of cap 22 is 5.75 inches. The material used in making the cap is preferably alloy steel, the entire device weighs about 60 pounds. As noted elsewhere, wire 14 crimped in the wire barrel was multistranded aluminum wire having a cross-sectional area of one million circular mils.

The foregoing detailed description has been given for clearness of understanding only, and no unnecessary limitations should be understood therefrom, as some modifications will be obvious to those skilled in the art.

What is claimed is:

1. A propellant-driven device for crimping a terminal into encompassing engagement with a wire, which comprises:

a. a housing having an elongated chamber with a first and a second end;

b. a fixed die positioned at the first end of the chamber;

c. a movable die slidingly positioned in the chamber which cooperates with the fixed die;

d. a lateral opening into the chamber for allowing the positioning of a terminal between the fixed and movable dies;

e. propellant means positioned at the second end for propelling the movable die toward the fixed die;

f. removable closure means for closing the second end of the chamber;

g. detonating means for detonating the propellant means, said detonating means positioned in the closure means;

h. a passage extending from the chamber adjacent the second end with a gas release pin slidingly positioned therein and adapted to removably seal the passage; and i. safety means pivotally connected to the closure means so that as it is pivoted outwardly it forces the gas release pin into sealing engagement in the passage.

* * * * *